US010132050B1

(12) United States Patent
Mandan

(10) Patent No.: US 10,132,050 B1
(45) Date of Patent: Nov. 20, 2018

(54) VARIABLE GEOMETRY BUCKET

(71) Applicant: Forest P. Mandan, New Town, ND (US)

(72) Inventor: Forest P. Mandan, New Town, ND (US)

( * ) Notice: Subject to any disclaimer, the term of this patent is extended or adjusted under 35 U.S.C. 154(b) by 0 days.

(21) Appl. No.: 15/965,323

(22) Filed: Apr. 27, 2018

(51) Int. Cl.
*E01H 5/06* (2006.01)
*E02F 3/96* (2006.01)
*E02F 3/815* (2006.01)
*E02F 3/407* (2006.01)

(52) U.S. Cl.
CPC ..... *E01H 5/065* (2013.01); *E02F 3/407* (2013.01); *E02F 3/8155* (2013.01); *E02F 3/96* (2013.01)

(58) Field of Classification Search
CPC ..... E01H 5/065; E01H 5/066; E01H 5/06; E01H 5/067; E02F 3/8155; E02F 3/815; E02F 3/7613; E02F 3/407; E02F 3/96
See application file for complete search history.

(56) References Cited

U.S. PATENT DOCUMENTS 1,502,591 A * 7/1924 Sargent ..... E01H 5/067 37/274
1,544,983 A * 7/1925 Heinzen ..... E01H 5/066 37/274
1,701,979 A * 2/1929 Linn ..... E01H 5/061 171/63
1,711,488 A * 5/1929 Bising ..... E01H 5/06 37/274
1,721,262 A * 7/1929 Snow, Jr. ..... E01H 5/06 37/271
1,743,969 A * 1/1930 Heinzen ..... E01H 5/067 192/109 D
1,747,302 A * 2/1930 Johnson ..... E01H 5/067 37/274
1,794,070 A * 2/1931 Frink ..... E01H 5/067 37/232
1,927,078 A * 9/1933 Weeks ..... E01H 5/067 37/234
1,956,007 A * 4/1934 Davin ..... E02F 3/7686 37/236
2,101,666 A * 12/1937 Austin ..... E01H 5/067 37/105
3,657,828 A * 4/1972 Anderson ..... E01H 5/065 172/815
4,074,448 A * 2/1978 Niemela ..... E01H 5/06 172/812
4,306,362 A * 12/1981 Waterman ..... E01H 4/02 37/219
4,479,312 A * 10/1984 Turgeon ..... E01H 4/02 172/815
4,552,226 A * 11/1985 Platter ..... E02F 3/815 172/815
4,723,609 A * 2/1988 Curtis ..... E02F 3/815 15/245

(Continued)

*Primary Examiner* — Jamie L McGowan
(74) *Attorney, Agent, or Firm* — Neustel Law Offices

(57) ABSTRACT

A Variable Geometry Bucket for material handling, such as plowing snow. The Variable Geometry Bucket generally includes four bucket members pivotally attached to each other. A pair of double-acting hydraulic cylinders can cause the outer bucket members to rotate on a frame, which in turn moves the inner bucket members. Due to the location of the pivotal connections, the bucket members can be moved into different positions, resulting in a single attachment that can be used as a V-blade, a box plow, and a bucket.

19 Claims, 6 Drawing Sheets

(56) References Cited

U.S. PATENT DOCUMENTS 4,779,363 A * 10/1988 Boutrais ..... A01C 3/04 172/815
5,488,996 A * 2/1996 Barry ..... A01B 73/065 172/311
5,599,135 A * 2/1997 Delaurenti ..... E01C 19/187 172/815
5,638,618 A * 6/1997 Niemela ..... E01H 5/06 172/782
5,655,318 A * 8/1997 Daniels ..... E01H 5/06 172/815
5,697,731 A * 12/1997 Bonds ..... E01C 19/00 172/815
5,819,444 A 10/1998 Desmarais
5,890,546 A * 4/1999 Kerpash, Sr. ..... A01B 31/00 172/397
6,035,944 A 3/2000 Neuner
6,112,438 A * 9/2000 Weagley ..... E01H 5/065 172/393
6,412,199 B1 7/2002 Quenzi
6,425,196 B1 * 7/2002 Weagley ..... E01H 5/065 172/393
6,523,620 B1 * 2/2003 Burson ..... E01H 5/066 172/815
6,691,435 B1 * 2/2004 Schultz ..... E01H 5/06 172/2
6,883,436 B2 * 4/2005 Fuerst ..... E01B 27/02 104/2
6,945,335 B2 9/2005 Suzuki
7,051,819 B1 * 5/2006 Schenk ..... E01H 1/003 172/782
7,360,327 B2 * 4/2008 Osgood ..... E01H 5/066 172/784
7,481,011 B2 * 1/2009 Nesseth ..... E01H 5/066 172/815
7,584,557 B1 * 9/2009 Nistler ..... E01H 5/065 37/234
7,805,866 B1 * 10/2010 Osgood ..... E01H 5/066 172/784
8,061,063 B2 * 11/2011 Gamble, II ..... E01H 5/063 172/815
8,689,897 B2 4/2014 May
9,068,324 B2 * 6/2015 Linder ..... E02F 3/8155
2008/0235996 A1 10/2008 Evans
2014/0237865 A1 8/2014 Jones

* cited by examiner

VARIABLE GEOMETRY BUCKET

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a Variable Geometry Bucket for changing the geometry and type of material handling attachment for use with skid steers, loaders, tractors, or other equipment.

Related Art

Any discussion of the related art throughout the specification should in no way be considered as an admission that such related art is widely known or forms part of common general knowledge in the field.

Current material handling attachments for skid loaders and other machines are not variable—in other words, for example, a V-blade attachment cannot be changed to form a bucket to lift, carry, and dump material being handled or moved. Thus, if a user needs to switch between a V-blade and a bucket, he must remove the V-blade attachment and install a bucket attachment. This not only requires time to accomplish, but also additional storage space for each individual attachment that a user might need for a job or machine.

When using a bucket and working with 'sticky" material such as snow, it sometimes sticks to the sides and bottom of the bucket and cannot be dumped, or dumped completely. Without any ability to change the shape/configuration of the bucket, there may be no easy way to completely dump material out of the bucket. Further, when using a bucket and pushing material, especially shallow material, there is no way to sweep material that has been pushed off to the sides of the bucket, back into the bucket. This is easily envisioned, for example, when plowing snow with a bucket and after accumulating in the bucket, the snow piles up and spills outside of the bucket in a ridge as the machine continues to move forward.

Also, when moving material that is too deep to use a V-blade within a narrow space (such as an alley or a trench), it may be necessary to use a bucket, but if the space is too narrow to turn the machine to dump the material, the user may need to back all the way out of the space in order to dump it.

SUMMARY

An example embodiment is directed to a Variable Geometry Bucket. The Variable Geometry Bucket (VGB) includes a rigid structural steel frame that is attached to the machine. A bottom plate of the bucket can be attached to the frame. The frame also forms a base for fixed pivots and double-acting hydraulic cylinders that cause the bucket sides to pivot forward or back, as needed. The bucket sides are connected with corner hinges to two blade sections that form the back of the bucket when the VGB is in bucket mode. By actuating the hydraulic cylinders and pivoting the bucket sides, the VGB blade sections can be moved to change the geometry of the VGB to a V-Blade, bucket, or box configuration (also known as a snow box).

In an example embodiment, the Variable Geometry Bucket can include a first frame member and a second frame member, where the first frame member is an upper arm on the left side of the VGB, and the second frame member is an upper member on the right side of the VGB. The example embodiment also includes a first pivot point on the first frame member and a second pivot point on the second frame member. A first bucket member is pivotally connected to the first frame member at a first pivot point, the first pivot point having an axis substantially perpendicular to the bottom plate.

The example embodiment also includes a second pivot point on the second frame member, the second bucket member pivotally connected to the second frame member at the second pivot point, the second pivot point having an axis substantially perpendicular to the bottom plate.

The example embodiment can also include a first actuator coupled to the frame at a first end and to the first bucket member at a second end, the first actuator operable to rotate the first bucket member about the first pivot point. It can also include a second actuator coupled to the frame at a first end and to the second bucket member at a second end, and the second actuator is operable to rotate the second bucket member about the second pivot point.

A third bucket member can be pivotally connected to the first bucket member at a first hinge position, for example, by one or more corner hinges. A fourth bucket member can be pivotally connected to the second bucket member at a second hinge position, also, for example, by one or more corner hinges. The third bucket member can be pivotally connected to the fourth bucket member at a position of the third bucket member distal from the first hinge position and at an edge of the fourth bucket member distal from the second hinge position.

In another example embodiment, the variable geometry bucket can also comprise a third frame member, such as a lower frame member on the left side of the VGB, and a fourth frame member, such as a lower frame member on the right side of the VGB. This embodiment can include a third pivot point on the third frame member, the third pivot point being substantially coaxial with the first pivot point (e.g., directly below the first pivot point), and a fourth pivot point on the fourth frame member, the fourth pivot point further being substantially coaxial with the second pivot point. The first bucket member is further pivotally connected to the third frame member at the third pivot point, and the second bucket member is further pivotally connected to the fourth frame member at the fourth pivot point.

In another example embodiment, the second end of the first (e.g., left) actuator is pivotally attached to an arm of the first bucket member, and similarly, the second end of the second actuator is pivotally attached to an arm of the second bucket member. The arms, being spaced apart from the main pivot attachment points (where the first and second bucket members attach to the frame) allows the actuators to move the bucket members using leverage.

In another example embodiment, any of the example embodiments may also include a bottom plate mounted on the frame, and each pivotal connection can include an axis that is substantially orthogonal to the bottom plate. The bottom plate can form a support for the moving bucket members, and can also serve as the bottom of the VGB when it is in bucket mode, as will be described in further detail below. When the actuators move the bucket members, the bottom edges of the bucket members may typically move in a plane parallel to, and possibly in contact with, the bottom plate.

In an example embodiment, the actuators can either extend or retract, and thus can cause the connected bucket members to rotate in either direction about the pivot points where they are connected to the frame. When the actuators are extended, the four bucket members may move into a substantially rectangular shape (when viewed from above), with an upper edge of the first bucket member being substantially parallel to an upper edge of the second bucket member, and wherein the third bucket member and the fourth bucket member are substantially linearly aligned.

In a further example embodiment of the variable geometry bucket, actuation of the first actuator and the second actuator to a retracted position moves the bucket members into a substantially V shape (again, when viewed from above), wherein the first bucket member and the third bucket member are substantially linearly aligned and the second bucket member and the fourth bucket member are substantially linearly aligned.

In a further example embodiment of the variable geometry bucket, actuation of the first actuator and the second actuator to a middle position moves the bucket members into a substantially W shape (viewed from above), wherein the first bucket member and the second bucket member comprise the outer blade faces of a box configuration.

There has thus been outlined, rather broadly, some of the embodiments of the Variable Geometry Bucket in order that the detailed description thereof may be better understood, and in order that the present contribution to the art may be better appreciated. There are additional embodiments of the Variable Geometry Bucket that will be described hereinafter and that will form the subject matter of the claims appended hereto. In this respect, before explaining at least one embodiment of the Variable Geometry Bucket in detail, it is to be understood that the Variable Geometry Bucket is not limited in its application to the details of construction or to the arrangements of the components set forth in the following description or illustrated in the drawings. The Variable Geometry Bucket is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

An example Variable Geometry Bucket 10 as shown in FIGS. 1-7 generally comprises a frame 20 that carries a bucket 30 comprising two bucket sides/outer blade faces 31*a* and 31*b* pivotally connected to two bucket backs/inner blade faces 32*a* and 32*b* (these terms for the bucket members will be used interchangeably, depending on the bucket/blade configuration) with corner hinges 34*a* and 34*b*. There is substantial symmetry in example embodiments of the VGB; therefore, generally, the "a" designation of parts herein will be used for components on the left side of the VGB when viewed from above, while the "b" designation will be used for corresponding parts on the right side, as viewed from above. Thus, bucket member 31*a* is on the left side of the VGB, while its counterpart bucket member 31*b* is on the right side.

The VGB 10 is designed for use as a versatile attachment for skid steers, loaders, tractors, etc. for material handling. As noted above, by using hydraulic cylinders, the sides and backs of the VGB 10 are hinged and can thus be moved, while the skid steer is being operated, into a bucket, box, or V-blade configuration. The VGB 10 can be attached to a machine using any known attachment method, such as a universal skid steer coupler.

The two bucket sides 31*a, b* pivot about a pivot point for each bucket side. The pivots are formed with two upper pivot bushings 26*a* and 26*b* securely attached to the frame 20, and pivot members 39*a* and 39*b*, which are securely attached to bucket members 31*a* and 31*b*. The pivots also include lower pivot bushings 27*a* and 27*b*, which are attached to the lower members 22*a* and 22*b*, respectively, and pivot members 43*a* and 43*b* which are attached to or part of bucket members 31*a* and 31*b*. The upper pivot members are secured to each other pivotally by pins 38*a* and 38*b*, and the lower members are secured to each other by pins 42*a* and 42*b*, so that there may be two pivotal connections for each bucket member, 31*a* and 31*b*, although other configurations (e.g., a different number of pivotal connections) are certainly possible.

Relative to the frame, the pivot point does not move when the geometry of the bucket 30 is changed. The two bucket sides 31*a*, 31*b* also include cylinder attachment pins 37*a* and 37*b* that secure the ends of two matched double-acting hydraulic cylinders 12*a* and 12*b* (i.e., actuators) to the bucket sides 31, by way of attachment arms 36*a* and 36*b* which form a lever by being spaced away from the pivot point on the frame 20. Upon actuation, the hydraulic cylinders 12*a* and 12*b* cause the bucket sides 31*a* and 31*b* to rotate about the pivot points, which changes the geometry and thus configuration of the VGB 10.

Figure 1:
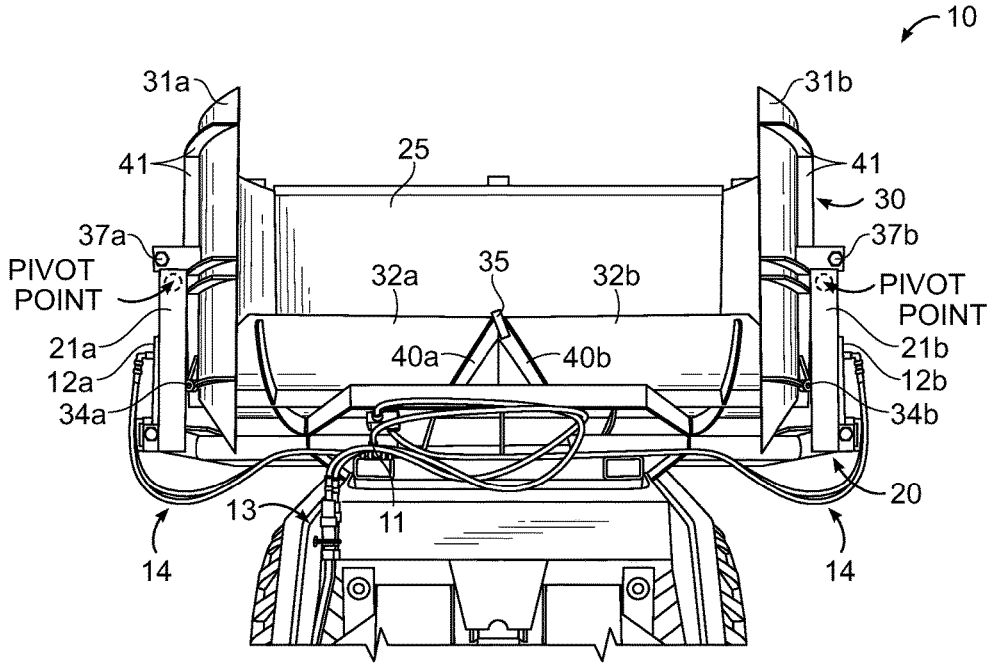
FIG. 1 is a top view of a Variable Geometry Bucket in bucket mode in accordance with an example embodiment.

In an example embodiment, the two bucket backs 32 are connected to the bucket sides (i.e., when the configuration or geometry is a bucket) by corner hinges 34, and are connected to each other by center hinges, a center hinge near the top and one near the bottom. In the bucket configuration, best shown in FIGS. 1 and 6, the hydraulic cylinders are in the full stroke position, which forces the corner hinges 34 as far apart as they can go, at the rear corners of the bucket. This action also pulls the two bucket backs 32*a* and *b* into substantial linear alignment at the back side of the bucket, as shown in FIG. 1.

Figure 3:
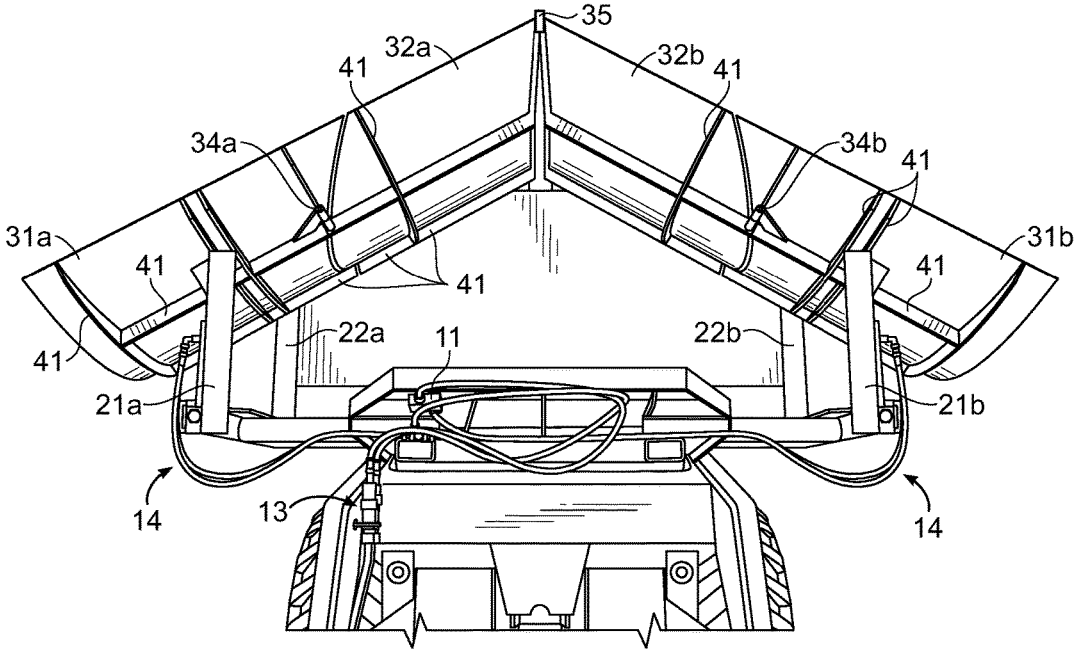
FIG. 3 is a top view of a Variable Geometry Bucket in V-blade mode in accordance with an example embodiment.
Figure 5:
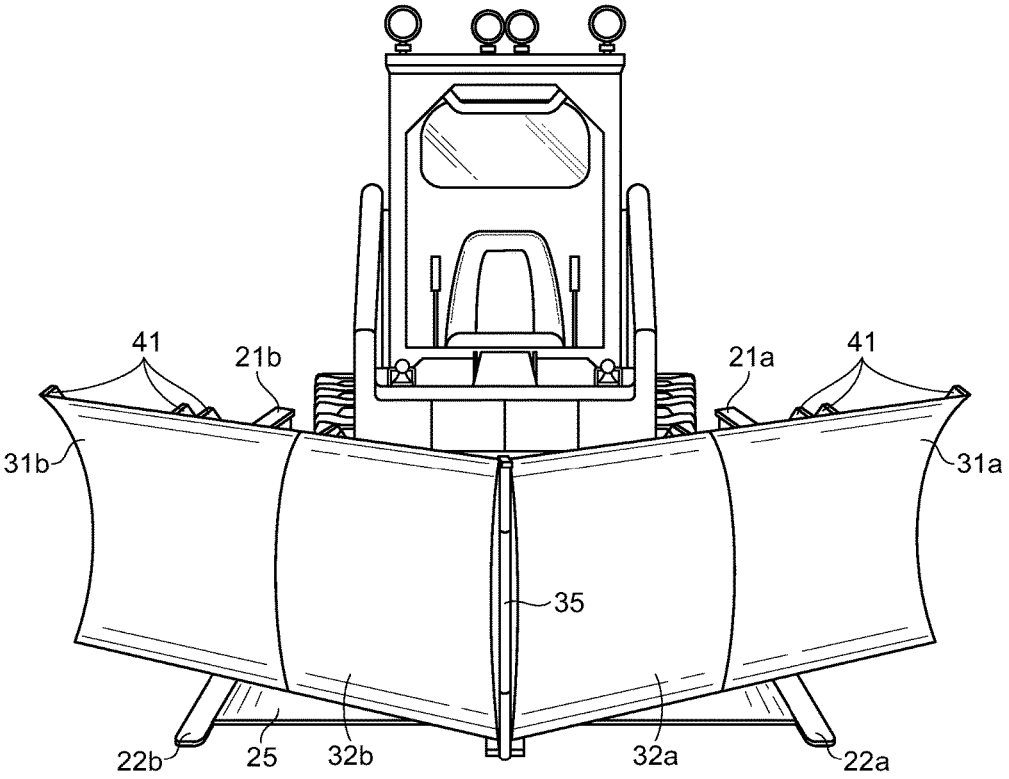
FIG. 5 is a front view of a Variable Geometry Bucket in V-blade mode in accordance with an example embodiment.

When the VGB is in the V-blade mode, the bucket sides 31*a* and 31*b* are rotated and become the outer blade faces of the V-blade, as shown in FIGS. 3 and 5. In this mode, the bucket backs 32*a* and *b* become the inner blade faces of the V-blade, with the center hinge 35 moving from its most rearward position to its most forward position, at the front and center of the V-blade.

Figure 2:
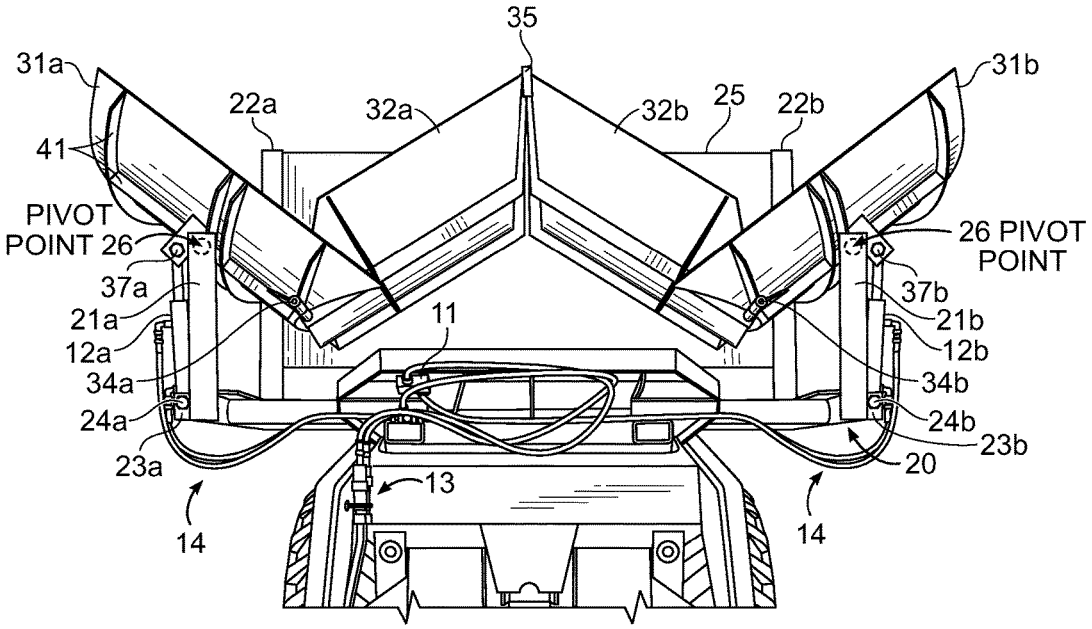
FIG. 2 is a top view of a Variable Geometry Bucket in box mode in accordance with an example embodiment.
Figure 7:
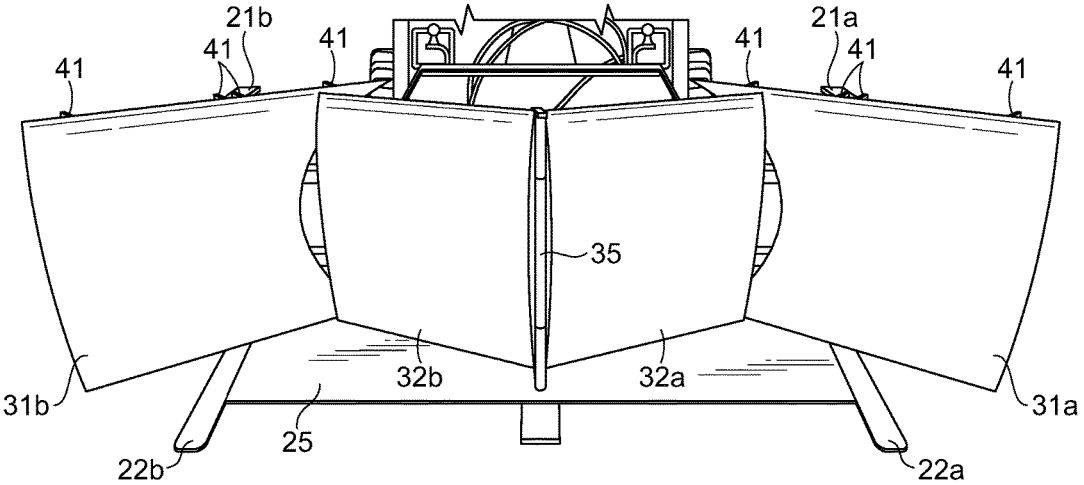
FIG. 7 is a front view of a Variable Geometry Bucket in box mode in accordance with an example embodiment.

Finally, when the VGB 10 is in box mode (a box plow is also known as a containment plow or a snow pusher), as shown in FIGS. 2 and 7, the hydraulic cylinders 12 are at a half stroke position, which results in the center hinges and inner blade faces being in a more rearward position from the V-blade mode, and also forms an approximately 100° angle between each inner blade face 32 and the outer blade face 31 to which it is attached. As with a conventional box plow, the outer blade faces 31*a* and 31*b* of the VGB act as sidewalls to help keep the snow or other material contained, allowing material to be moved by pushing it straight ahead without creating a ridge that will need to be removed later.

B. Frame

Figure 4:
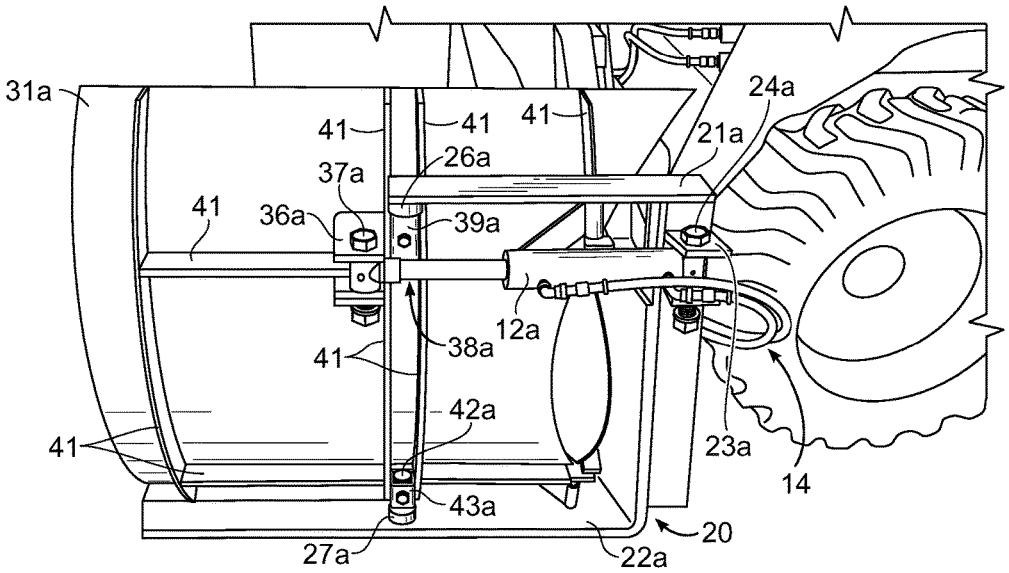
FIG. 4 is a side view of a Variable Geometry Bucket in bucket mode in accordance with an example embodiment.

In an example embodiment, the VGB comprises a rigid structural steel frame 20 that is mountable on a skid steer, tractor, loader, etc. in a conventional manner, such as with a universal skid steer mount. The frame 20 can include two upper frame members 21*a* and 21*b*, one on each side of the frame as shown in FIGS. 2 and 4. The frame 20 can also include two lower frame members 22*a* and 22*b* on each side, as also shown in FIGS. 2 and 4. The frame also includes a cylinder attachment bracket 23*a* and 23*b* on each side, to which one end of a double-acting hydraulic cylinder 12*a* and 12*b* is mounted with a pin 24*a* and 24*b*, respectively.

The pins 24 can be shoulder bolts that are inserted through the upper and lower ends of the cylinder attachment brackets 23 and secured with a nut at the other end. A similar attachment method can be used for the end of the cylinders 12*a* and 12*b* attached to the bucket sides 31*a* and 31*b*, also using shoulder bolts and nuts.

As with other hydraulically-powered attachments, the VGB 10 includes hydraulic hoses 14 that attach the two double-acting hydraulic cylinders 12*a* and *b* to the machine's remote hydraulic connection 13, as shown in FIGS. 1-3.

To ensure that the movable bucket members 31*a* and 31*b* and 32 move in a synchronized, coordinated fashion and don't lock or jam, in an example embodiment the VGB 10 can include a pressure-compensated hydraulic divider/combiner valve 11. The hydraulic divider/combiner valve 11 ensures that both hydraulic cylinders 12*a* and *b* are synchronized and move the same amount regardless of load, which keeps the bucket sides 31*a* and 31*b* at the same angle on both sides of the VGB regardless of which mode the system is being operated in.

As shown in FIG. 1, the divider/combiner valve 11 can be mounted at or near the top, rear portion of the frame, for example, near the remote hydraulic connection 13 of a skid steer. This allows the hydraulic hoses 14 to be routed for minimal movement during actuation of the hydraulic cylinders, and also allows the entire VGB to be tilted, raised, and lowered by the skid steer lift arms while maintaining the hydraulic connection.

The frame 20 may be similar to a forklift attachment, but also includes a bottom plate 25 which serves as the bottom of the bucket in bucket mode, and also adds rigidity to the bucket. The bottom plate 25 also provides a base along which the bucket sides and backs slide when the user changes the geometry or "mode" of the VGB 10. As with the other main components of the VGB, the bottom plate 25 may be made of steel, such as rolled plate steel. The bottom plate 25 does not move when the bucket sides and backs are moved to put the VGB into a different mode of operation, and it supports the blades/bucket members. When the VGB is in bucket mode, the bottom plate 25 serves as the bottom of the bucket, and performs the function just as with a conventional bucket attachment.

As shown in FIG. 3, when the VGB is in V-blade mode, most of the bottom plate 25 is behind the blades of the plow, and so the operation of the VGB in pushing snow or other material is performed just as with a conventional V-blade.

The frame 20 also includes two upper pivot bushings 26*a* and 26*b*, one on each side of the frame, rigidly attached to upper frame members 21*a* and *b*, respectively. Similarly, the frame 20 includes two lower pivot bushings 27*a* and *b* rigidly attached to lower frame members 22*a* and 22*b*. The upper and lower pivot bushings are aligned and create a pivot point for the bucket sides about which bucket sides 31*a* and 31*b* can rotate when the hydraulic cylinders 12*a* and *b* are actuated. All pivots and hinges of the VGB 10 are rod and bushing type, and may be grease lubricated through conventional grease fittings (zerks). In addition, in an example embodiment all the pivot and hinge axes can be orthogonal to the bottom plate 25, so that the four bucket members 31*a* and *b*, 32*a* and *b* move in a plane parallel to the bottom plate 25.

The frame 20, as stated above, is rigid, and provides fixed pivot points for the movable bucket/blade members, and also mounting points for the hydraulic cylinders 12*a* and 12*b*. As with conventional buckets, plows, and other attachments for skid steers, loaders, etc., the VGB frame 20 itself can be moved in various ways by the lift arms, such as raising, lowering, and tilting.

C. Bucket/Blades

In an example embodiment, the VGB comprises a bucket made up of four individual pieces that, if all aligned, would be in the form of a concave steel blade. The four individual bucket members may be made of rolled plate steel, reinforced with ribs as shown in the various figures. As best shown in FIG. 4, each bucket side 31 may be reinforced with four or more vertical ribs 41 made of structural steel, contoured to match the curvature of the bucket side and securely attached to the bucket sides, such as by welding. For added strength and rigidity, two of the ribs 41 may be close to each other near the pivot point, and can also serve as an attachment points for pivot members 39*a* and *b*, which can be integral, welded, or otherwise attached to one or both of the ribs.

A vertical rib 41 at the back "corner" of the bucket, on the bucket sides 31*a* and 31*b*, can also be used to strengthen the rear portion of bucket sides 31*a* and 31*b*, and to provide an attachment point for the upper barrel of each corner hinge 34*a* and *b*, which can be attached to the outside of the rib, as shown in FIG. 2.

As also shown in FIG. 4, the bucket sides 31*a* and 31*b* can also include horizontal reinforcing ribs 41, also made of structural steel welded to the back side of the bucket sides. In the example embodiment, the ribs are positioned near the center and bottom of the bucket sides. Also in the example embodiment, the bucket backs include horizontal, structural steel ribs 41 substantially aligned with the horizontal ribs of the bucket sides. The end faces of the horizontal ribs 41 can meet and act as positional "stops" when the VGB is moved into V-blade mode.

As best shown in FIG. 3, the bucket backs can also include vertical reinforcing ribs 41 welded or attached to the backsides.

Figure 6:
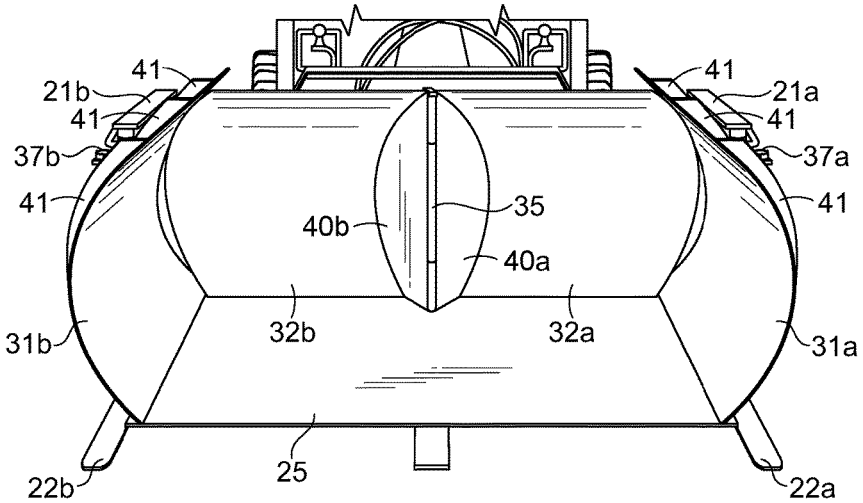
FIG. 6 is a front view of a Variable Geometry Bucket in bucket mode in accordance with an example embodiment.

In bucket mode, the sides of the bucket are formed by bucket members (sides) 31*a* and 31*b* as shown in FIGS. 1 and 6. As shown, the forward edges of bucket sides 31*a* and 31*b* may be straight, as with the forward edge of a conventional bucket. However, in the example embodiment, the rearward edge of the bucket sides 31*a* and 31*b* may be curved, as shown in FIG. 4. This curvature can be made to match the curve of the edges of bucket backs 32*a* and *b* when the bucket members are in alignment, as best shown in FIG. 5.

As shown in FIGS. 3 and 5, when in V-blade mode, the curved edges allow for the inner blade faces 31*a* and 31*b* to form two fairly straight, continuous V-blade elements with the outer blade faces 32*a* and 32*b*. The curved blade edges also allow the edges to move past each other without binding when the hydraulic cylinders 12*a* and *b* are actuated to change the geometry of the VGB, for example, from bucket mode to box and V-blade mode.

The two bucket sides 31*a* and 31*b* include pivot members 39, a top pivot member and bottom pivot member for each bucket side. The pivot members are connected to the frame with upper pivot pins 38*a* and 38*b*, which, with upper pivot bushings 26*a* and *b* and lower pivot bushings 27*a* (left) and 27*b* (right) form pivot points about which the bucket sides 31*a* and 31*b* rotate when the double-acting hydraulic cylinders 12*a* and 12*b* are actuated, to change the mode (geometry) of the VGB. The pivot bushings 26*a*, 26*b*, and 27*a, b* are securely attached to the frame 20, and do not move when the geometry of the bucket is changed. The two bucket sides 31*a* and *b* also include attachment arms 36*a* and *b*, and cylinder attachment pins 37*a* and 37*b* that secure the ends of two matched double-acting hydraulic cylinders 12*a* and 12*b* and allow the cylinders to act upon the bucket sides 31*a* and 31*b*. As with the frame attachment, the pins 37*a* and 37*b* that attach the front of the actuators, cylinders 12*a* and *b*, to the attachment arms 36*a* and *b* can be shoulder bolts, secured to the arms with nuts.

Upon actuation, the hydraulic cylinders act on the attachment arms 36*a* and 36*b* and cause the bucket sides to rotate about the pivot points, which changes the geometry and thus configuration of the VGB 10.

In an example embodiment, bucket members or "backs" 32*a* and 32*b* are connected to bucket sides 31*a* and 31*b*, respectively, by corner hinges 34*a* and 34*b*, and are connected to each other by a center hinge 35. The axis of each corner hinge is orthogonal to the bottom plate 25. These features ensure that the bucket members 31*a* and 31*b*, and 32*a* and 32*b* rotate and move in a substantially horizontal plane, parallel to the bottom plate 25, and with the bottom plate 25 form either a bucket, box, or V-blade attachment, depending on the selected mode.

As best shown in FIGS. 1 and 6, each bucket back 32*a, b* also includes a flat plate 40*a, b* that closes the center of the bucket to prevent material from spilling out of, or moving past, the bucket, box, or V-blade. The barrel portions of the center hinge 35 are attached to the flat plates 40*a, b*, and secured by a hinge pin. In the bucket configuration, the hydraulic cylinders 12 are in the full stroke position, which forces the corner hinges 34*a* and *b* as far apart and rearward as they can go, at the rear corners of the bucket. This selected position also pulls the two bucket backs 32*a* and 32*b* substantially into linear alignment at the back side of the bucket.

When the VGB is in the V-blade mode, the bucket sides or members 31*a* and *b* are rotated by the hydraulic cylinders 12*a* and *b* (which are in a "no stroke" condition in this mode) and become the outer blade faces of the V-blade, as shown in FIG. 3. In this mode, the bucket backs or members 32*a* and *b* become the inner blade faces of the V-blade, with the center hinge 35 moving from its most rearward position to its most forward position, at the front and center of the V-blade. In V-blade mode, the VGB acts as a conventional V-blade in plowing or pushing material such as snow, to clear a central path and pile material on both sides of the blade.

Finally, when the VGB is in box mode, as shown in FIGS. 2 and 7, both hydraulic cylinders 12 are at a half-stroke position, which results in the center hinges and inner blade faces being in a more rearward position from the V-blade mode, and also forms an approximately 100° angle (the precise angle is not critical) between inner blade face 32*a* and outer blade face 31*a*, and between inner blade face 32*b* and outer blade face 31*b*. As with a conventional box plow, the outer blade faces 31*a* and 31*b* of the VGB act as sidewalls to help keep snow or other material contained, allowing material to be moved by pushing it straight ahead without creating a ridge that will need to be removed or plowed again at a later point in time.

D. Operation of Preferred Embodiment

In use, each mode of the VGB acts as one of three different plow configurations, and is used as such. Thus, in bucket mode, the VGB acts and is used just as a conventional bucket attachment, to push, lift, and dump material being handled, such as snow. Obviously, a V-blade and a box plow do not have all the capabilities of a bucket, as their ability to lift and dump material is extremely limited, although a V-blade and a box can push snow up onto previously piled snow to some extent.

Plowing snow that has frozen over time, or that is very deep, is often easier with the plow in V-blade mode, due to the plow's sharply angled leading edge. Box mode can also be effective in snow that has been frozen, thawed, and re-frozen, etc., with the added advantage of preventing snow from spilling past the outside edges to the same degree as a V-blade.

Even though conventional V-blades can be adjusted with moving, hydraulically actuated blades, a conventional V-blade plow cannot be configured as a box or a bucket. Similarly, a bucket or box plow cannot be changed to another configuration, and certainly not to a V-blade. Thus, to achieve the same functions of each would require three separate plows or skid steer attachments using conventional equipment.

As shown in the Figures, the VGB can be used in any geometry that is allowed by the position of the double-acting hydraulic cylinders 12*a* and 12*b*, the four bucket/blade members (i.e., the bucket sides and backs), and the hinges 34*a* and *b*, and 35. Because the hydraulic cylinders 12 are synchronized to each other, and because the bucket sides 31*a* and 31*b* pivot about a fixed point, the positions of the bucket members 31*a* and 31*b* and 32*a* and 32*b* relative to each other are consistent and repeatable. Further, the change between the various possible modes can be done while the skid steer or other machine is in motion, and can be accomplished quite rapidly due to the hydraulic cylinders 12 acting on levered attachment arms 36*a* and 36*b* attached to bucket sides 31*a* and 31*b*.

In bucket mode (i.e., when the four bucket members form a substantially rectangular shape), the hydraulic cylinders 12 are in full-stroke position, and the bucket members of sides 31*a* and 31*b* are rotated as far forward as possible (i.e., viewed from the top, bucket side 31*a* is rotated fully clockwise, and bucket side 31*b* is fully counterclockwise), with the concave blade faces facing the middle. This rotation, acting on the corner hinges 34*a* and 34*b*, pulls the bucket backs 32*a* and 32*b* straight, into or nearly into linear alignment with each other. In this mode, the VGB can be used just as a conventional bucket is used, to scrape or push material, lift it, transport it, and dump it, for example.

From bucket mode, actuation of the hydraulic cylinders 12 to or near the halfway position rotates the back corner of the bucket sides 31*a* and 31*b* toward the center, which pushes the center of the hinged bucket backs 32*a* and 32*b* forward to create the "box" geometry, as shown in FIG. 2. The hydraulic cylinders 12*a* and *b* hold the VGB 10 in this position, and the box can be used just as a conventional box or "snow pusher" to push material, such as snow, in a straight line with minimal spilling of material past the edges. Notably, the VGB 10 can be put into bucket mode for transport, which is narrower than box mode, which may allow transport that would not be possible with a fixed box plow.

Further retraction of the cylinders 12*a* and 12*b* moves the bucket sides 31*a* and 31*b* to their most rearward position, where they become outer blade faces of a V-blade. Also in this condition, the bucket backs 32*a* and 32*b* are in their forward-most position, and they act as the inner blade faces of the V-blade. In this position, the flat plates 40*a* and 40*b* are now at the front, center location of the plow, and are aligned in the direction of plow travel, which allows for a sharp-pointed V-blade with a closed front section (i.e., no open gap between inner blades 32*a* and 32*b*). As with a conventional V-blade, this configuration allows material to be pushed equally to the sides to clear a center path, and is well suited for working in deep snow, for example.

In addition to the ability to simply change the geometry of the bucket members/blades, being able to do so while in motion provides other advantages, as follows:

Sweep/Bite: For example, when transforming from box to bucket mode, the Variable Geometry Bucket can sweep material onto the bottom plate 25, helping to fill the bucket by moving snow, etc., into the bucket. To accomplish this, starting from box mode, the cylinders 12*a* and 12*b* are actuated to pivot the outer blade faces 31*a* and 31*b* forward, which moves their outside edges toward the center, and also pushes the snow or other material into the bucket.

This is especially effective when working with shallow material. This sweep/bite action can be performed in coordinated fashion, while the skid steer is moving forward.

V Dump: As another example, which is useful when working with "sticky" material like heavy or wet snow, sometimes the material sticks to the bottom or sides of the bucket and will not fall out when the bucket is tilted forward. When this happens, the operator of the VGB can actuate the cylinders while the bucket is tilted to move the VGB into or toward the V-blade position, which pushes the material off the bottom plate 25. In most cases, even a relatively small amount of movement of the bucket members 31 and 32 may be enough to push any remaining snow or other material out of the bucket, once the bucket is tilted forward, so it will not always be necessary to move the VGB all the way into V-blade position to quickly dump the load.

Figure 8A:
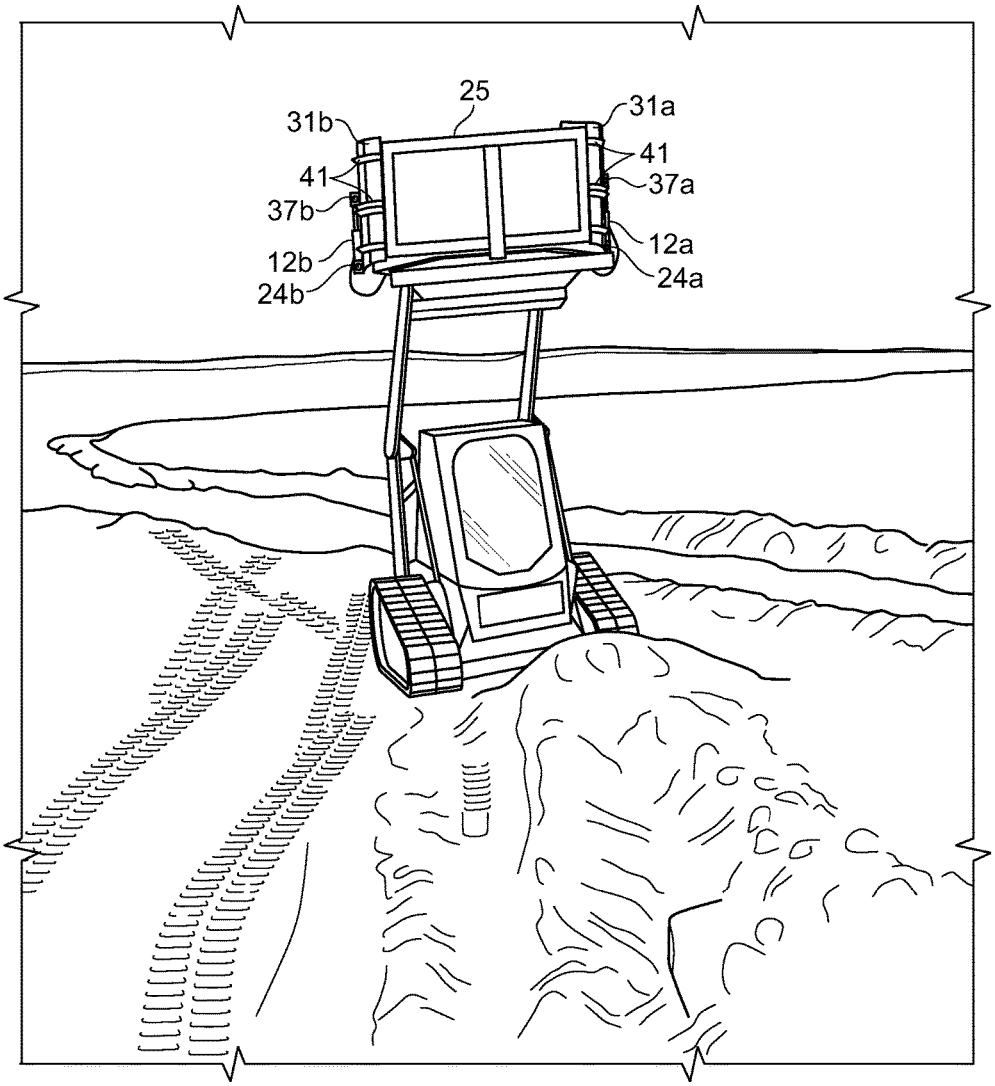
FIG. 8A is a front view of a Variable Geometry Bucket in bucket mode just prior to executing a "side dump" in accordance with an example embodiment.
Figure 8B:
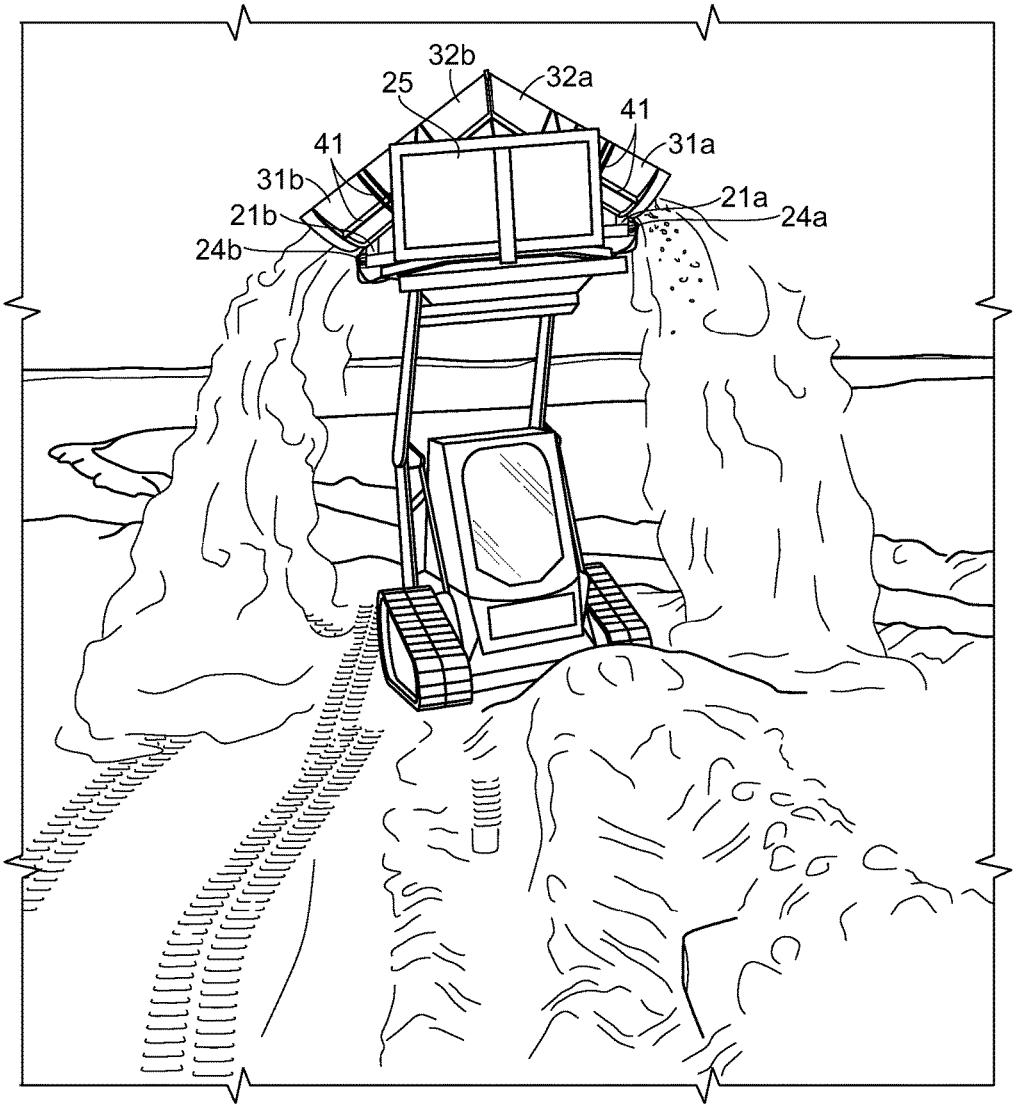
FIG. 8B is a front view of a Variable Geometry Bucket in V-blade mode during a "side dump" in accordance with an example embodiment.

Side Dump: If an operator is digging or plowing in an alley or trench where the material is too deep or heavy to use a V-blade, or wishes to clear a single-width path, using a conventional bucket could require the operator to fill the bucket and back all the way out of the alley or trench to dump the bucket. With the VGB, the operator can instead simply dig a full bucket of material, lift the bucket high above the skid steer and the alley or trench, and tilt the bucket so that the bottom plate 25 is nearly vertical, as shown in FIG. 8A. Next, the operator can open the bucket all the way into V-blade mode, which will cause the material to dump equally to both sides of the alley or trench (off the outer blade faces 32*a* and 32*b*), as shown in FIG. 8B.

Unless otherwise defined, all technical and scientific terms used herein have the same meaning as commonly understood by one of ordinary skill in the art to which this invention belongs. Although methods and materials similar to or equivalent to those described herein can be used in the practice or testing of the Variable Geometry Bucket, suitable methods and materials are described above. All publications, patent applications, patents, and other references mentioned herein are incorporated by reference in their entirety to the extent allowed by applicable law and regulations. The Variable Geometry Bucket may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A variable geometry bucket, comprising:

a frame comprising a first frame member, a second frame member, a third frame member, and a fourth frame member;

a first pivot point on the first frame member;

a second pivot point on the second frame member;

a third pivot point on the third frame member, the third pivot point being substantially coaxial with the first pivot point; and a fourth pivot point on the fourth frame member, the fourth pivot point being substantially coaxial with the second pivot point;

a first bucket member pivotally connected to the first frame member at the first pivot point;

a second bucket member pivotally connected to the second frame member at the second pivot point;

a first actuator coupled to the frame at a first end and to the first bucket member at a second end, the first actuator operable to rotate the first bucket member about the first pivot point;

a second actuator coupled to the frame at a first end and to the second bucket member at a second end, the second actuator operable to rotate the second bucket member about the second pivot point;

a third bucket member pivotally connected to the first bucket member at a first hinge position; and a fourth bucket member pivotally connected to the second bucket member at a second hinge position;

wherein the third bucket member is pivotally connected to the fourth bucket member at a position of the third bucket member distal from the first hinge position and at an edge of the fourth bucket member distal from the second hinge position; and wherein the first bucket member is further pivotally connected to the third frame member at the third pivot point and wherein the second bucket member is further pivotally connected to the fourth frame member at the fourth pivot point.

2. The variable geometry bucket of claim 1, wherein the second end of the first actuator is pivotally attached to an arm of the first bucket member, and wherein the second end of the second actuator is pivotally attached to an arm of the second bucket member.

3. The variable geometry bucket of claim 1, wherein the first pivot point comprises a bushing attached to the first frame member, and wherein the second pivot point comprises a bushing attached to the second frame member.

4. The variable geometry bucket of claim 1, wherein the first actuator and the second actuator comprise double-acting hydraulic cylinders.

5. The variable geometry bucket of claim 1, further comprising a bottom plate mounted on the frame.

6. The variable geometry bucket of claim 5, wherein each pivotal connection comprises an axis that is substantially orthogonal to the bottom plate.

7. The variable geometry bucket of claim 5, wherein each bucket member comprises a bottom edge that moves substantially in a plane adjacent to a surface of the bottom plate when the first and second actuators cause the bucket members to move.

8. The variable geometry bucket of claim 7, wherein the second end of the first actuator is pivotally attached to an arm of the first bucket member, and wherein the second end of the second actuator is pivotally attached to an arm of the second bucket member.

9. The variable geometry bucket of claim 1, wherein the first actuator is adapted to rotate the first bucket member about the first pivot point in either direction, and wherein the second actuator is adapted to rotate the second bucket member about the second pivot point in either direction.

10. The variable geometry bucket of claim 9, wherein the first actuator is adapted to rotate the first bucket member about the first pivot point in either direction, and wherein the second actuator is adapted to rotate the second bucket member about the second pivot point in either direction.

11. The variable geometry bucket of claim 1, wherein actuation of the first actuator and the second actuator to a retracted position moves the bucket members into a substantially V shape, wherein the first bucket member and the third bucket member are substantially linearly aligned and wherein the second bucket member and the fourth bucket member are substantially linearly aligned.

12. The variable geometry bucket of claim 1, further comprising a hydraulic divider/combiner valve, wherein the positions of the first actuator and the second actuator are substantially synchronized by the hydraulic divider/combiner valve.

13. A variable geometry bucket, comprising:

a frame comprising a first frame member and a second frame member;

a first pivot point on the first frame member;

a second pivot point on the second frame member;

a first bucket member pivotally connected to the first frame member at the first pivot point;

a second bucket member pivotally connected to the second frame member at the second pivot point;

a first actuator coupled to the frame at a first end and to the first bucket member at a second end, the first actuator operable to rotate the first bucket member about the first pivot point;

a second actuator coupled to the frame at a first end and to the second bucket member at a second end, the second actuator operable to rotate the second bucket member about the second pivot point;

a third bucket member pivotally connected to the first bucket member at a first hinge position; and a fourth bucket member pivotally connected to the second bucket member at a second hinge position;

wherein the third bucket member is pivotally connected to the fourth bucket member at a position of the third bucket member distal from the first hinge position and at an edge of the fourth bucket member distal from the second hinge position; and wherein actuation of the first actuator and the second actuator to an extended position moves the bucket members into a substantially rectangular shape, wherein an upper edge of the first bucket member is substantially parallel to an upper edge of the second bucket member, and wherein the third bucket member and the fourth bucket member are substantially linearly aligned.

14. A variable geometry bucket, comprising:

a frame comprising a first frame member and a second frame member;

a first pivot point on the first frame member;

a second pivot point on the second frame member;

a first bucket member pivotally connected to the first frame member at the first pivot point;

a second bucket member pivotally connected to the second frame member at the second pivot point;

a first actuator coupled to the frame at a first end and to the first bucket member at a second end, the first actuator operable to rotate the first bucket member about the first pivot point;

a second actuator coupled to the frame at a first end and to the second bucket member at a second end, the second actuator operable to rotate the second bucket member about the second pivot point;

a third bucket member pivotally connected to the first bucket member at a first hinge position; and a fourth bucket member pivotally connected to the second bucket member at a second hinge position;

wherein the third bucket member is pivotally connected to the fourth bucket member at a position of the third bucket member distal from the first hinge position and at an edge of the fourth bucket member distal from the second hinge position; and wherein actuation of the first actuator and the second actuator to a middle position moves the bucket members into a substantially W shape, wherein the first bucket member and the second bucket member comprise the outer blade faces of a box configuration.

15. A variable geometry bucket, comprising:

a frame comprising a first frame member and a second frame member;

a first pivot point on the first frame member;

a second pivot point on the second frame member;

a first bucket member pivotally connected to the first frame member at the first pivot point;

a second bucket member pivotally connected to the second frame member at the second pivot point;

a first actuator coupled to the frame at a first end and to the first bucket member at a second end, the first actuator operable to rotate the first bucket member about the first pivot point;

a second actuator coupled to the frame at a first end and to the second bucket member at a second end, the second actuator operable to rotate the second bucket member about the second pivot point;

a third bucket member pivotally connected to the first bucket member at a first hinge position; and a fourth bucket member pivotally connected to the second bucket member at a second hinge position;

wherein the third bucket member is pivotally connected to the fourth bucket member at a position of the third bucket member distal from the first hinge position and at an edge of the fourth bucket member distal from the second hinge position; and wherein actuation of the first actuator and the second actuator to an extended position moves the bucket members into a substantially rectangular shape, wherein an upper edge of the first bucket member is substantially parallel to an upper edge of the second bucket member, and wherein the third bucket member and the fourth bucket member are substantially linearly aligned, wherein actuation of the first actuator and the second actuator to a retracted position moves the bucket members into a substantially V shape, wherein the first bucket member and the third bucket member are substantially linearly aligned and wherein the second bucket member and the fourth bucket member are substantially linearly aligned, and wherein actuation of the first actuator and the second actuator to a middle position moves the bucket members into a substantially W shape, wherein the first bucket member and the second bucket member comprise the outer blade faces of a box configuration.

16. A variable geometry bucket, comprising:

a frame comprising a first frame member and a second frame member;

a bottom plate mounted on the frame;

a first pivot point on the first frame member;

a second pivot point on the second frame member;

a first bucket member pivotally connected to the first frame member at the first pivot point, the first pivot point having an axis substantially perpendicular to the bottom plate;

a second bucket member pivotally connected to the second frame member at the second pivot point, the second pivot point having an axis substantially perpendicular to the bottom plate;

a first actuator coupled to the frame at a first end and to the first bucket member at a second end, the first actuator operable to rotate the first bucket member about the first pivot point;

a second actuator coupled to the frame at a first end and to the second bucket member at a second end, the second actuator operable to rotate the second bucket member about the second pivot point;

a third bucket member pivotally connected to the first bucket member at a first hinge position;

a fourth bucket member pivotally connected to the second bucket member at a second hinge position;

a third frame member;

a fourth frame member;

a third pivot point on the third frame member, the third pivot point being substantially coaxial with the first pivot point; and a fourth pivot point on the fourth frame member, the fourth pivot point being substantially coaxial with the second pivot point;

wherein the third bucket member is pivotally connected to the fourth bucket member at a position of the third bucket member distal from the first hinge position and at an edge of the fourth bucket member distal from the second hinge position, and wherein the first bucket member is further pivotally connected to the third frame member at the third pivot point and wherein the second bucket member is further pivotally connected to the fourth frame member at the fourth pivot point.

17. The variable geometry bucket of claim 16, wherein the second end of the first actuator is pivotally attached to an arm of the first bucket member, and wherein the second end of the second actuator is pivotally attached to an arm of the second bucket member.

18. The variable geometry bucket of claim 16, further comprising a hydraulic divider/combiner valve, wherein the positions of the first actuator and the second actuator are substantially synchronized by the hydraulic divider/combiner valve.

19. The variable geometry bucket of claim 17, wherein each pivotal connection comprises an axis that is substantially orthogonal to the bottom plate, and wherein each bucket member comprises a bottom edge that moves substantially in a plane adjacent to a surface of the bottom plate when the first and second actuators cause the bucket members to move.

* * * * *